United States Patent [19]

McCall et al.

[11] Patent Number: 5,032,059

[45] Date of Patent: Jul. 16, 1991

[54] SUCTION AND PUMPING APPARATUS

[76] Inventors: Colin L. McCall; Royston S. McCall, both of 97 Medley Avenue, Liverpool, New South Wales 2170, Australia

[21] Appl. No.: 334,005

[22] Filed: Apr. 5, 1989

[51] Int. Cl.[5] ..... F04F 5/48

[52] U.S. Cl. ..... 417/183; 417/193; 4/544

[58] Field of Search ..... 417/151, 183, 193; 4/541, 542, 544

[56] References Cited

U.S. PATENT DOCUMENTS

| | | | |
|---|---|---|---|
| 536,415 | 3/1895 | Bogert | 417/183 |
| 950,774 | 3/1910 | Strain et al. | 417/193 |
| 1,854,098 | 4/1932 | Black | 417/183 |
| 2,888,191 | 5/1959 | Neumann et al. | 417/183 |
| 3,960,175 | 6/1976 | Liepe et al. | 417/183 |
| 4,402,094 | 9/1983 | Sanders | 4/544 |
| 4,602,391 | 7/1986 | Shepherd | 4/544 |
| 4,928,885 | 5/1990 | Nakao | 4/542 |

*Primary Examiner*—Leonard E. Smith
*Assistant Examiner*—M. Kocharov
*Attorney, Agent, or Firm*—Ladas & Parry

[57] ABSTRACT

The present invention discloses a venturi pumping arrangement which is used to pump fluids or solutions with a high efficiency. The arrangement comprises an inner pipe and an outer pipe having a passage therebetween. The inner pipe is partially located in the venturi shaped profile of the outer pipe. A chamber has an inlet through which a fluid is passed under pressure which in turn passes through the passage which produces a reduced pressure within the outer pipe which causes a second fluid to be drawn through the inner pipe into the outer pipe. The clearance of the passage is able to be varied on the arrangement to provide variable load performance.

6 Claims, 17 Drawing Sheets

SUCTION AND PUMPING APPARATUS

The present invention relates to suction and pumping apparatus, and, in particular, to a suction and pumping apparatus which uses the properties of a venturi shaped pipe to give an improved performance.

In the many applications which involve the pumping of fluids, a major expense of operation is the high cost of purchasing the apparatus. The apparatus has to be of a size whereby a vacuum is created of an extent sufficient to move the fluid being pumped. The size and power rating of the pump motor depends on the efficiency of the pump. Another expense is the running cost of such a motor.

A venturi pump system has been disclosed in Australian Patent Application No. 18345/83. This specification disclosed a venturi pump which created a partial vacuum to pump large objects in slurries. The specification also disclosed an adjustable venturi which was able to be adjusted according to particular requirements.

It is an object of the present invention to provide improved suction and pumping apparatus which substantially improves pump operation, thus reducing both in capital costs and operational or running costs.

According to one aspect of the present invention there is disclosed a venturi pumping arrangement comprising an inner pipe and an outer pipe and a chamber inlet means in said chamber to permit a first fluid under pressure to be introduced into said chamber, an outlet of restricted size leading from said chamber and directed towards one end of said inner pipe, whereby passage of said first fluid through said outlet and beyond said one inner pipe end produces a reduced pressure within said outer pipe which is able to draw a second fluid through said inner pipe, through said one end and into said outer pipe.

Some embodiments of the present invention will now be described with reference to the drawings in which.

Figure 7:
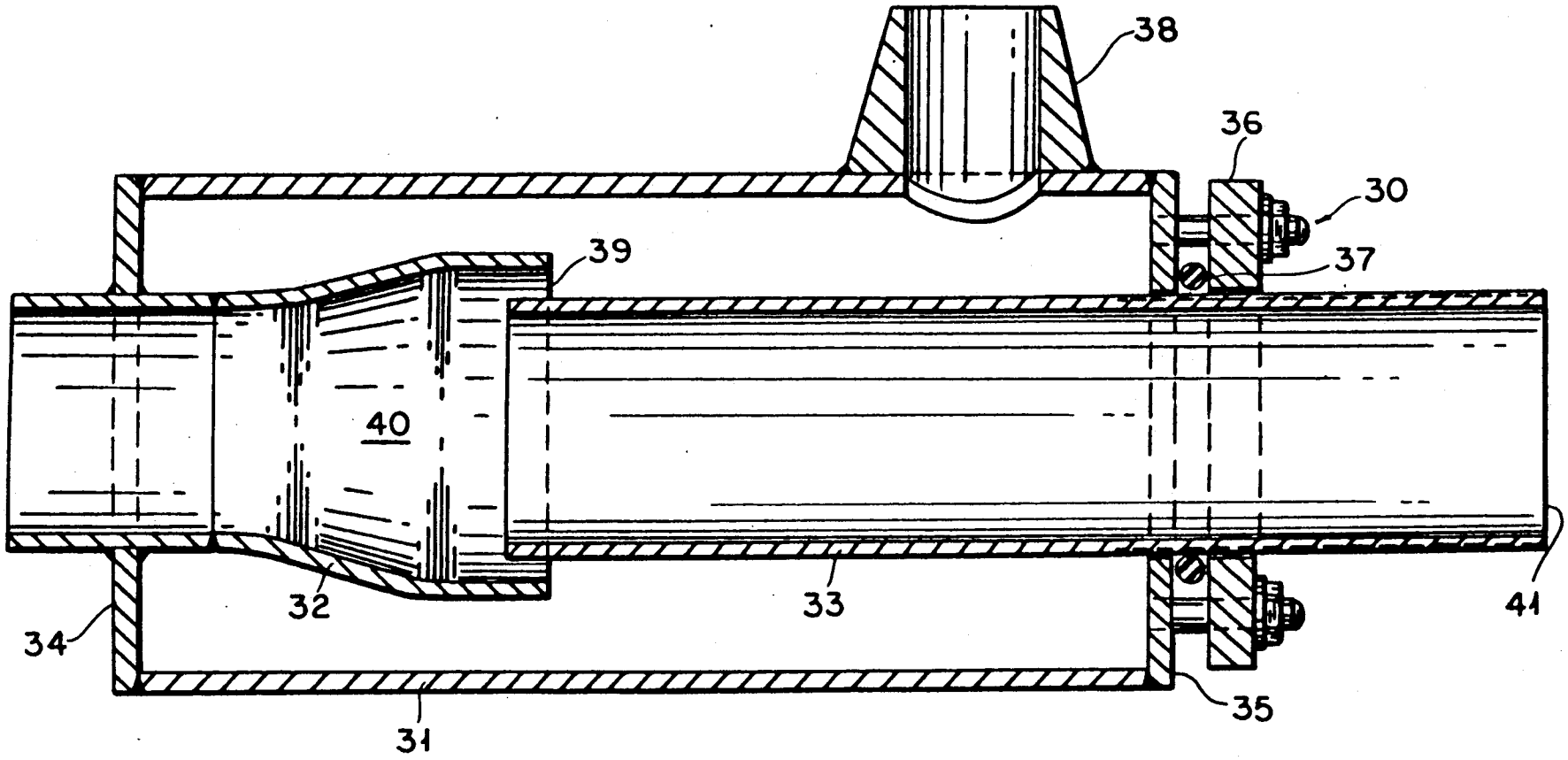
FIGS. 7–11 are central longitudinal cross-section views of connecting member apparatus of further embodiments.
Figure 13:
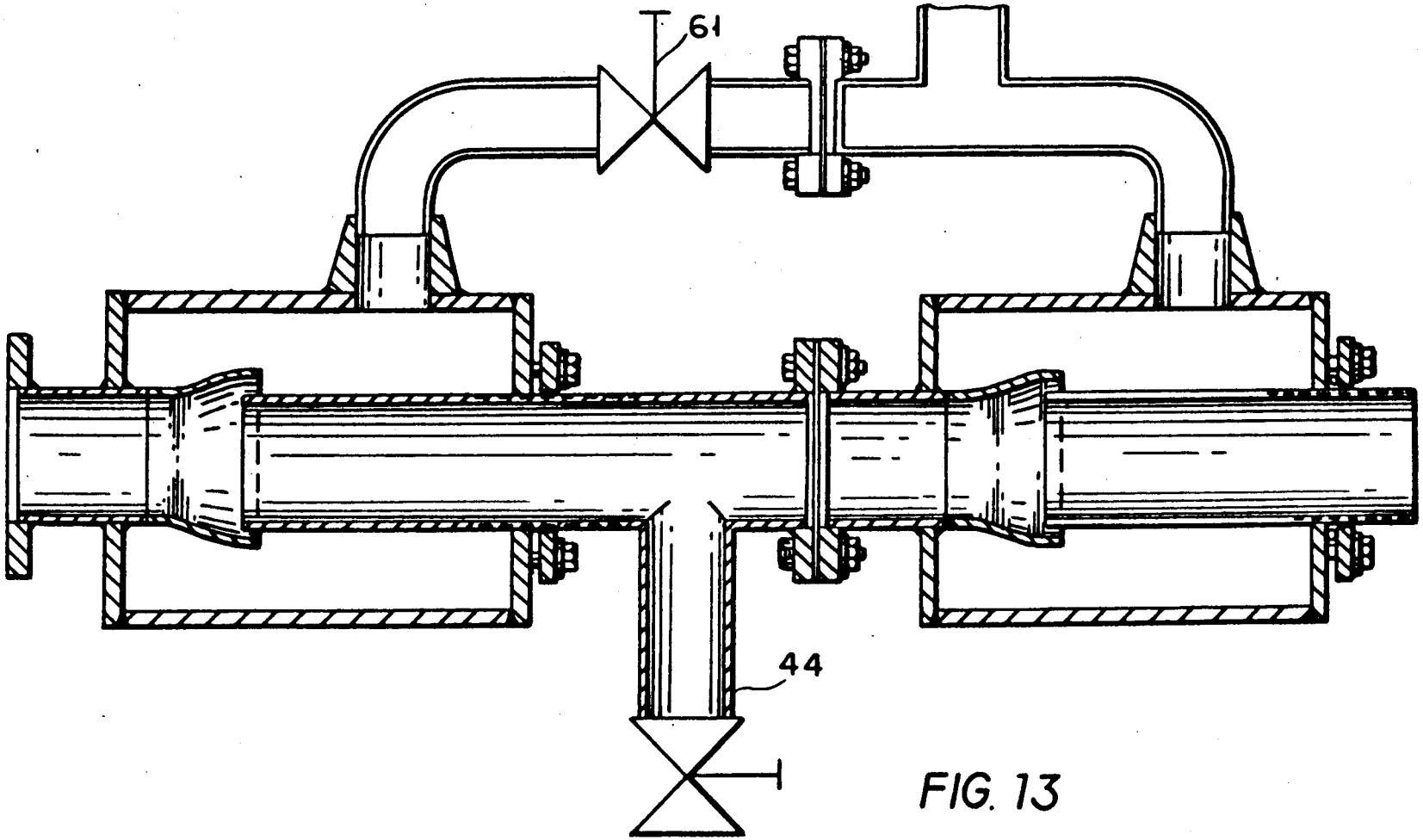
Figure 14:
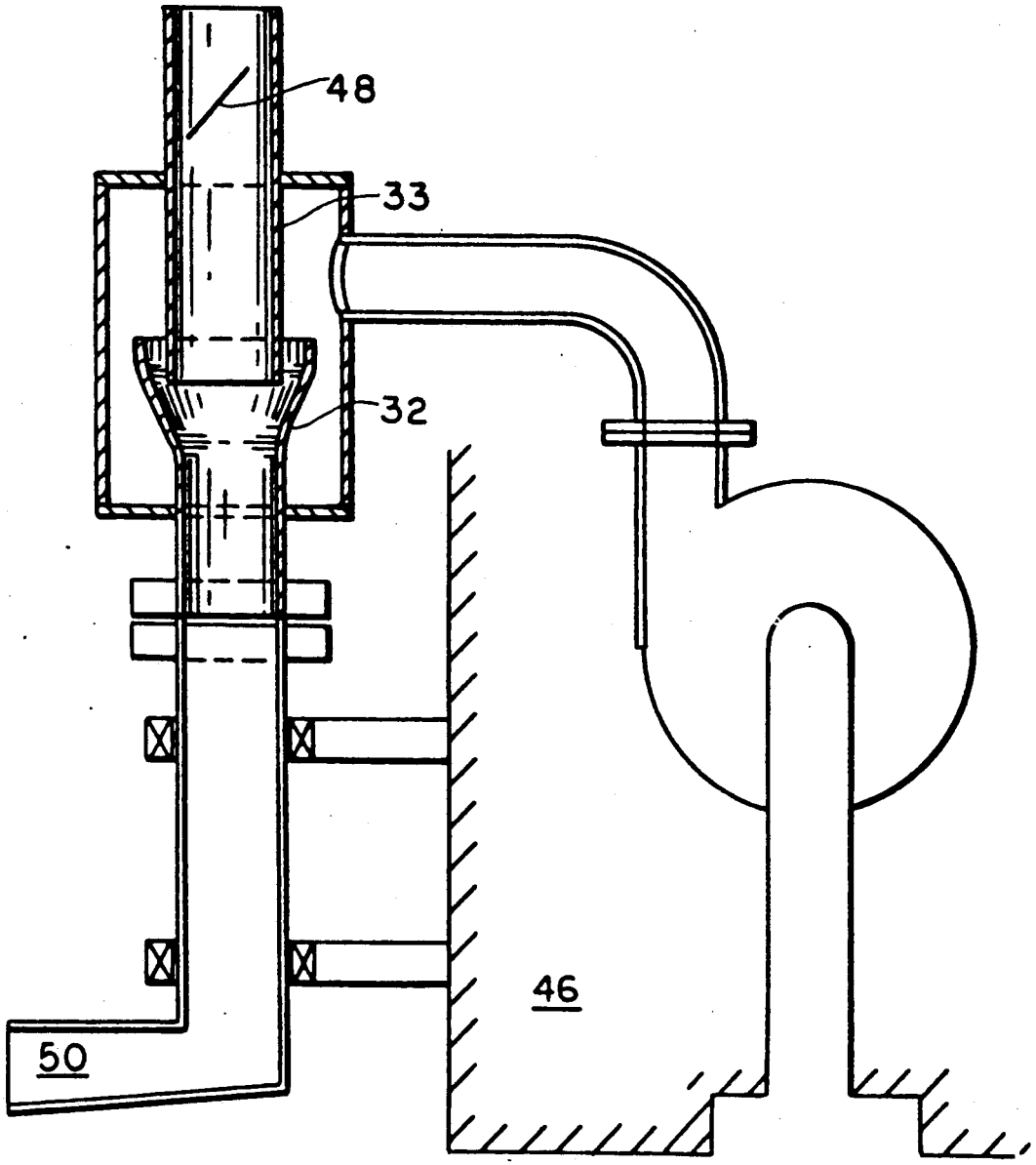
Figure 15:
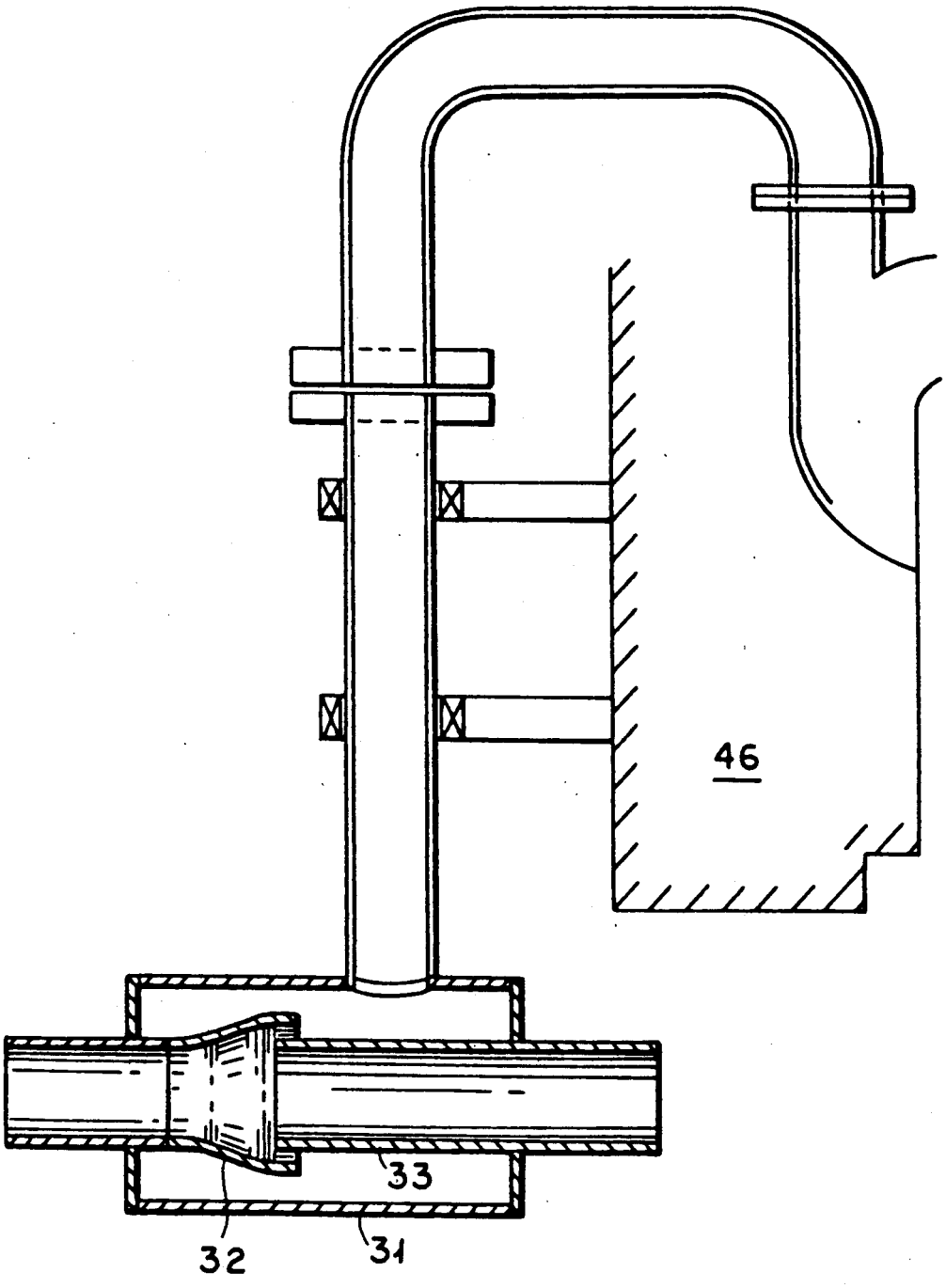
Figure 16:
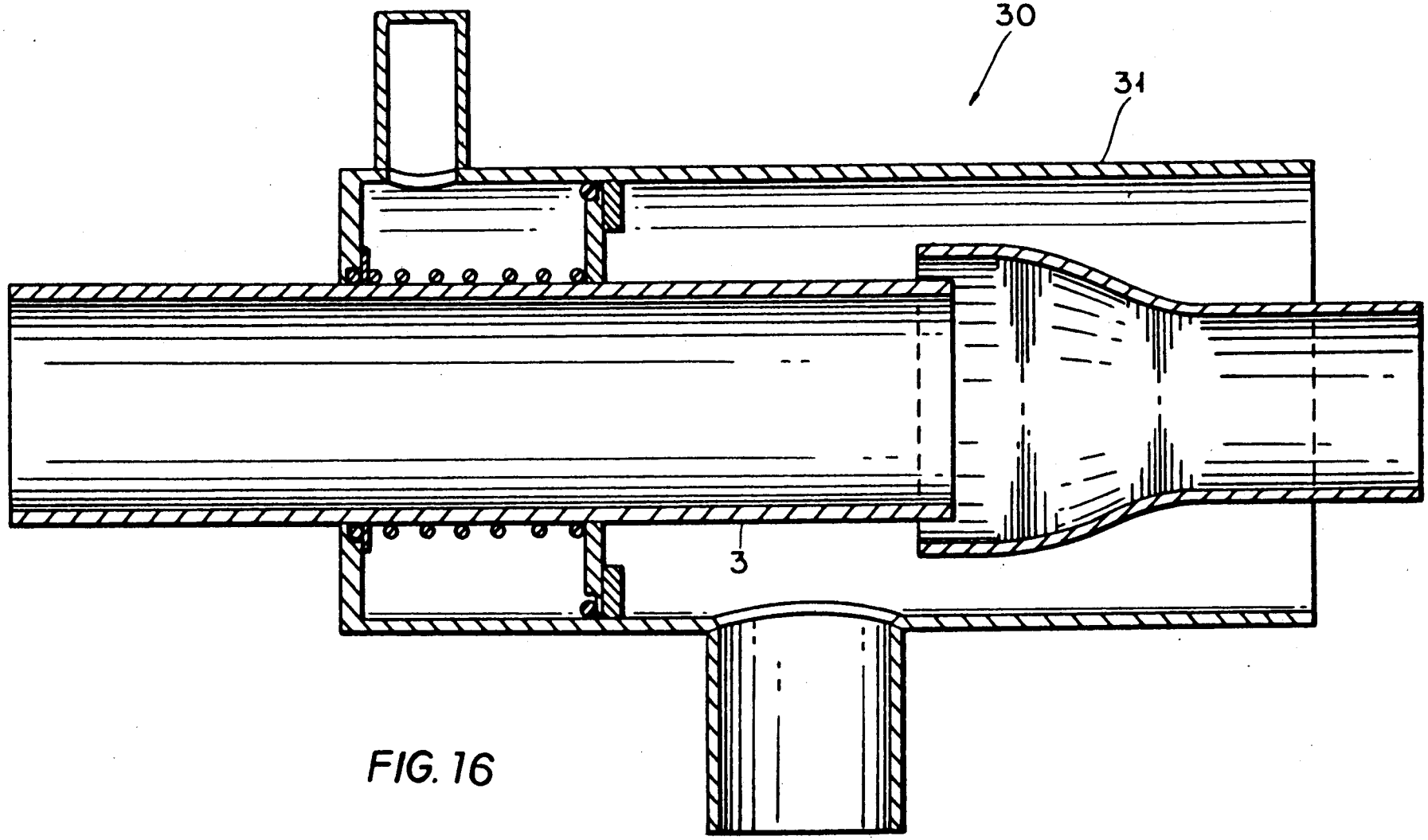
Figure 17:
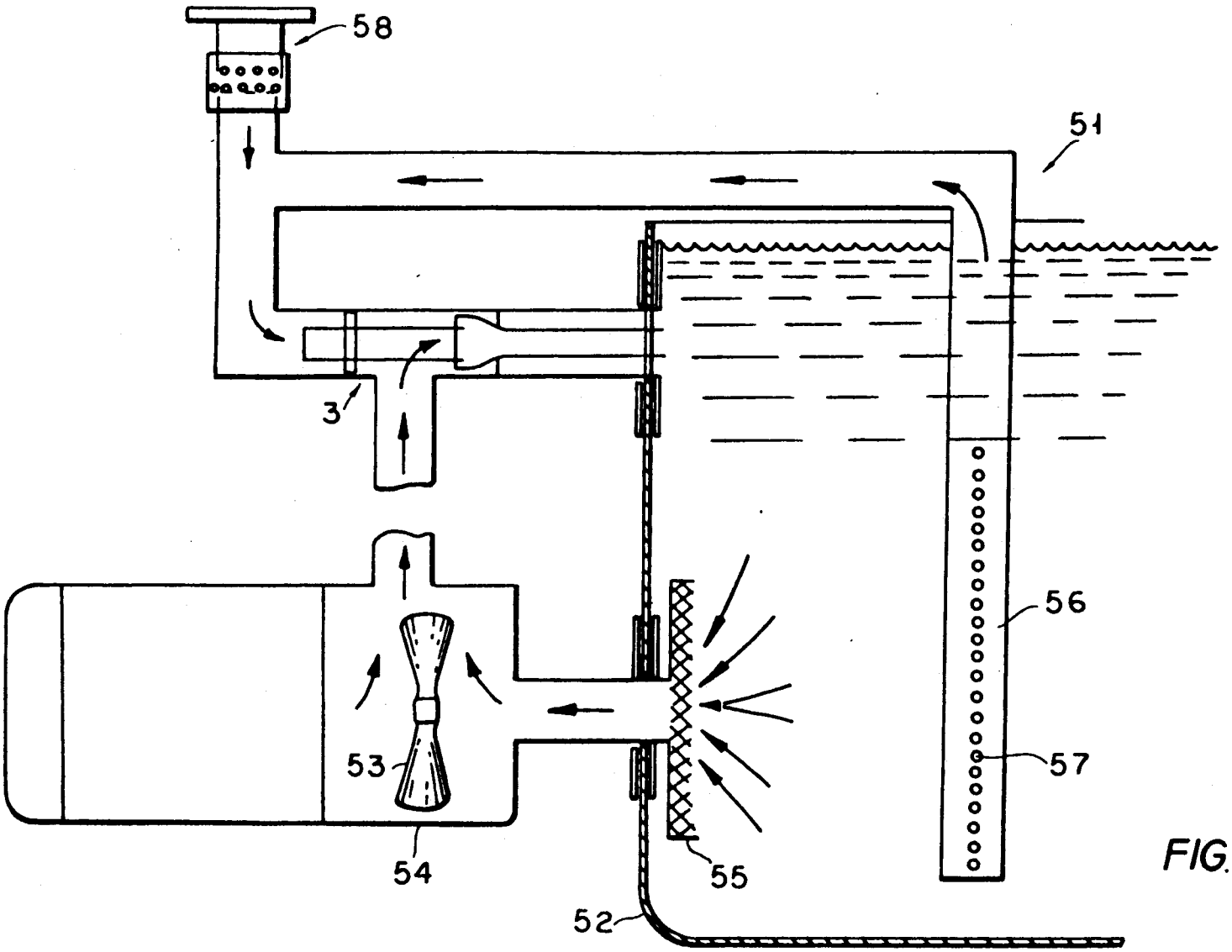

FIG. 13. is a central longitudinal of a connection using the apparatus of FIG. 7, FIGS. 14 and 15 are longitudinal cross-sectional views of pumping arrangements used to propell water craft, FIG. 16 is a cross-sectional view of another embodiment of the present invention, and FIG. 17 is a schematic diagram of the apparatus of the present invention being used to operate a water circulation circuit.

The connecting member 1 of a preferred embodiment as illustrated in FIGS. 1 to 4 comprises an outer pipe connector 2 and an inner pipe connector 3. The outer pipe connector 2 has at its connection end 4 a substantially venturi shaped profile. The outer pipe connector 2 has an end plate 5 which has a threaded aperture 6. The end plate 5 seals the outer pipe connector 2 at its connection end 4. The aperture 6 of the end plate 5 is threadedly engaged with the inner pipe connector 3 which is thus able to be reciprocated along its longitudinal axis inside the outer pipe connector 3. The end plate 5 and the inner pipe connector 2 have a lock nut 8 which forms a fluid tight seal. If desired a sealing washer or O-ring can be located between plate 5 and nut 8. At the inner end 9 of the inner plate connector 3 an annular ring 10 having a tapered outer circumference 11 is fitted around the outside of the pipe connector 3. The reciprocal movement of the inner pipe connector 3 allows the clearance between the annular ring 10 and the inside of the outer pipe connector 2 to vary according to the position of the inner pipe connector.

A chamber 12 is formed between the outer pipe connector 2, the inner pipe connector 3, the end plate 5 and the annular ring 10 and has an annular configuration. The chamber 12 has an inlet 13 through the outer pipe connector 2 and an annular outlet 14 which is the clearance between the inside of the outer pipe connector 2 and the annular ring 10.

In operation, a fluid under pressure is introduced through the inlet 13 into the chamber 12. The fluid then passes through the outlet 14 of the chamber 12 at a high velocity due to the venturi principle being applied through the narrowed opening of the outlet 14. The high velocity of the fluid passing through the outlet 14 accelerates the fluid in the direction shown by the arrow A. The high pressure and high velocity of the fluid causes a vacuum to be created around the end 9 of the inner pipe connector 3. If the other end 16 of the inner pipe connector 3 is open, suction is formed thus allowing any fluid, liquid, gas, slurry, dry solids or like materials to be sucked or pumped through the connector 3.

In general, the connecting member 1 of this preferred embodiment has a performance which is thought to be determined by the venturi shape of the outer pipe connector 2. Any fluid, i.e. gas or liquid under pressure can be used to pass through the connecting member 1 to cause the partial vacuum. Naturally, the various dimensions of the connecting member 1 can vary depending on each particular use. The inlet 13 can be of any size and be set at any angle thus directing the pressurized fluid into the chamber 12 which also can be of any size. Naturally, the sealing between the inner pipe connector and the end plate does not have to be threaded seal.

Some particular advantages of the present invention include that the outlet 14 of the member 1 is adjustable, i.e. the clearance between the annular ring 10 and the outer pipe connector 2 is also adjustable depending on the desired pressure, velocity and volume rate. The size of the clearance affects the performance of such variables as flow, rate, suction strength, and exit end velocity.

Figure 1:
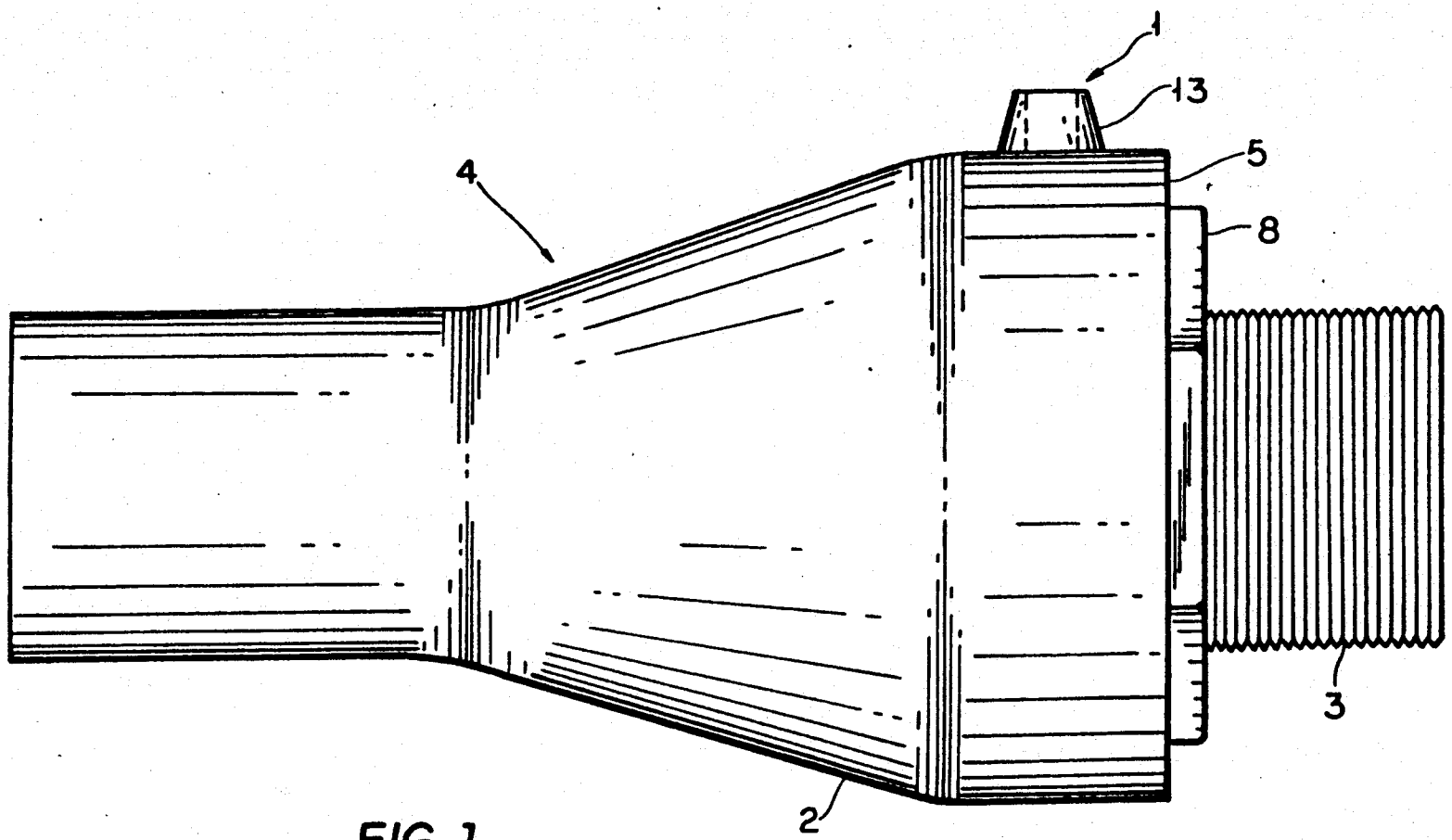
FIG. 1 is a plan view of a connecting member apparatus of a preferred embodiment.
Figure 2:
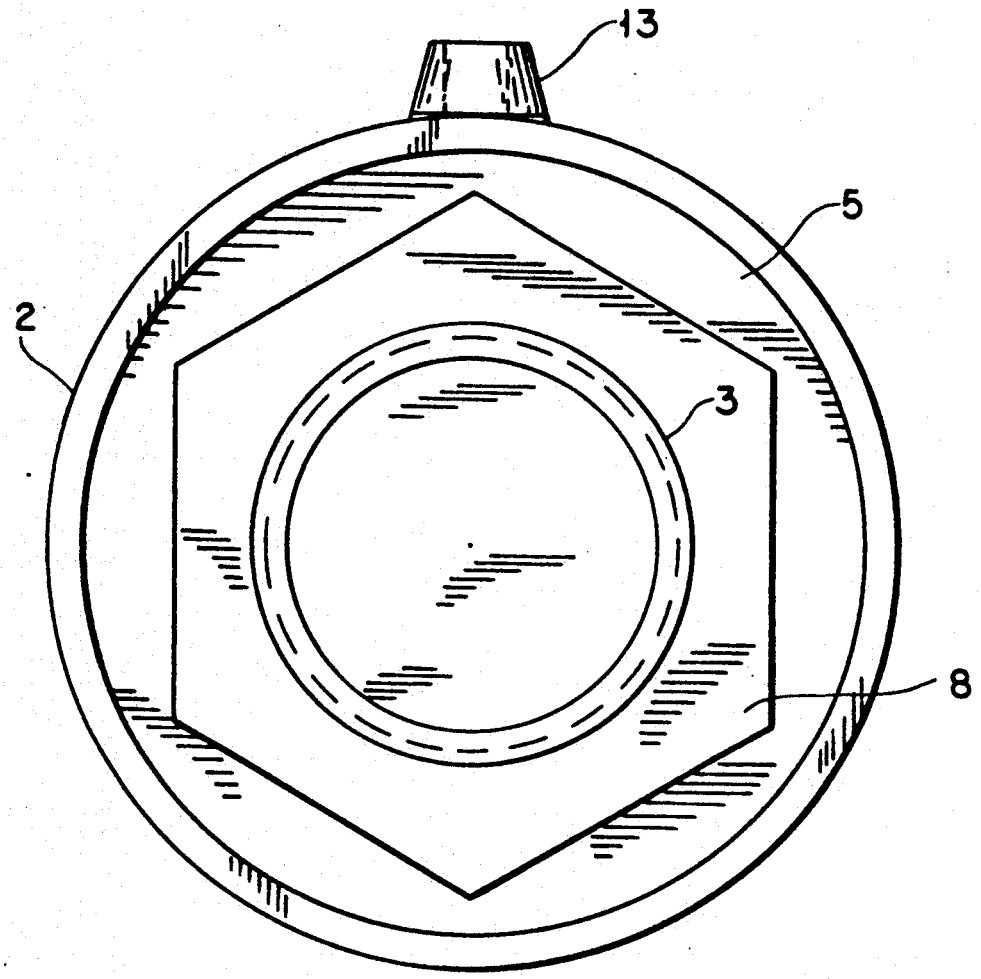
FIG. 2 is a one end view of the apparatus of FIG. 1.
Figure 3:
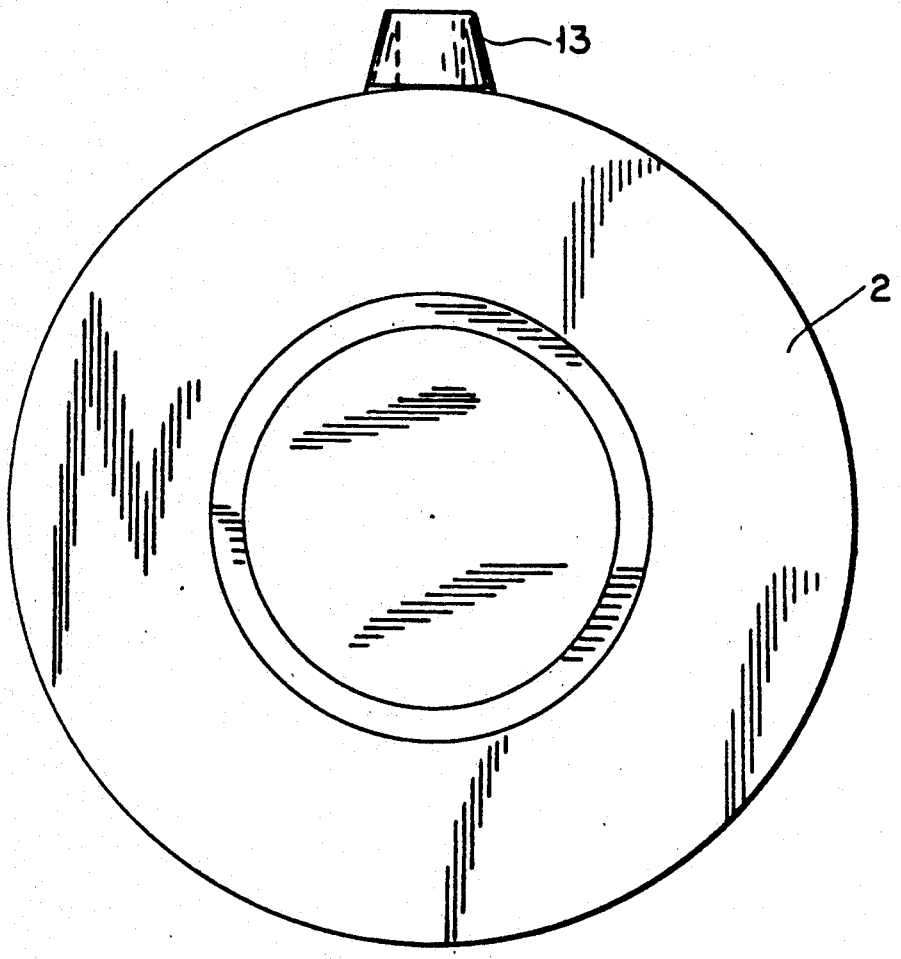
FIG. 3 is the opposite end view of the apparatus of FIG. 1.
Figure 4:
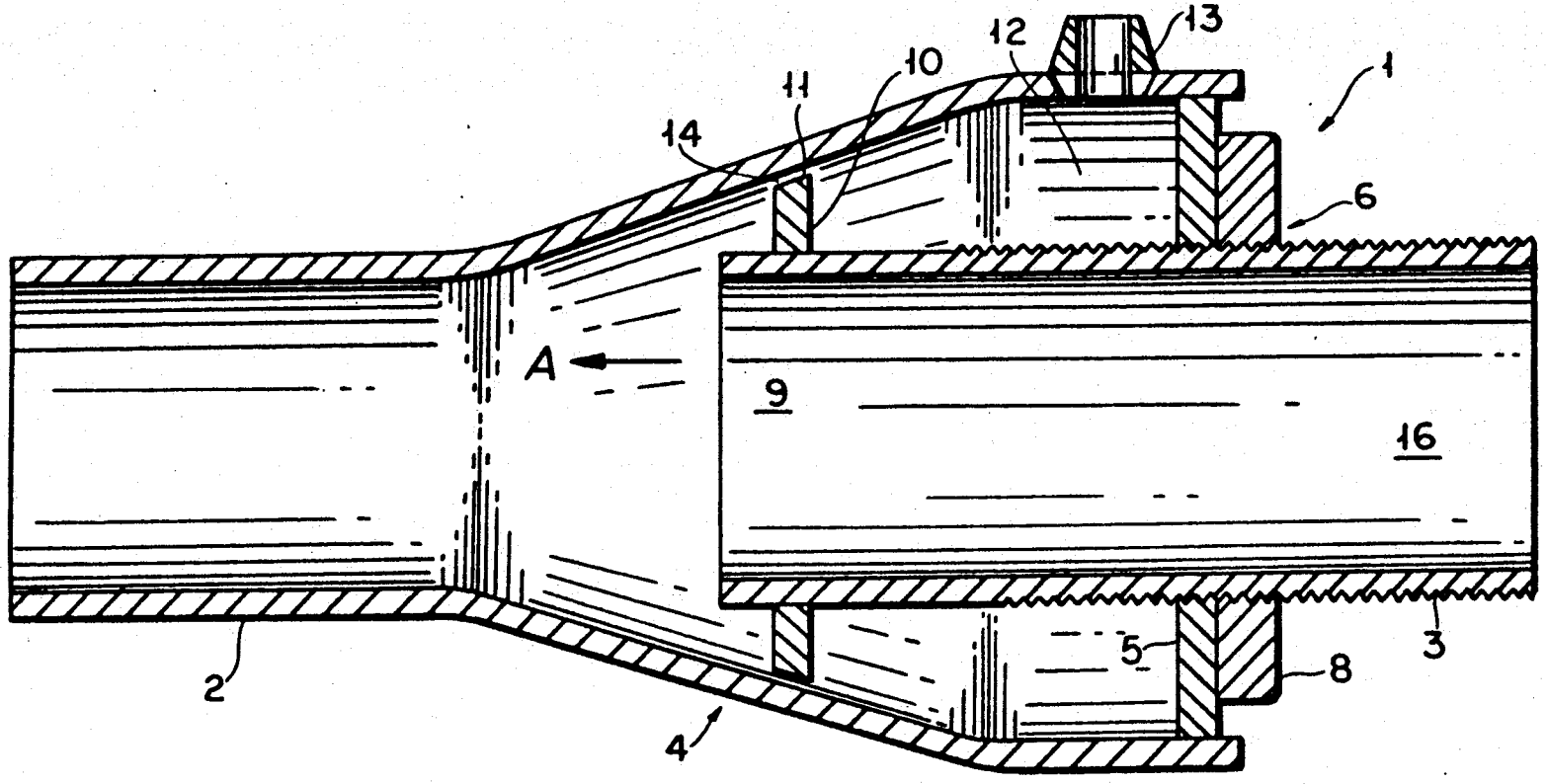
FIG. 4 is a central longitudinal cross-section through the apparatus of FIG. 1.
Figure 5:
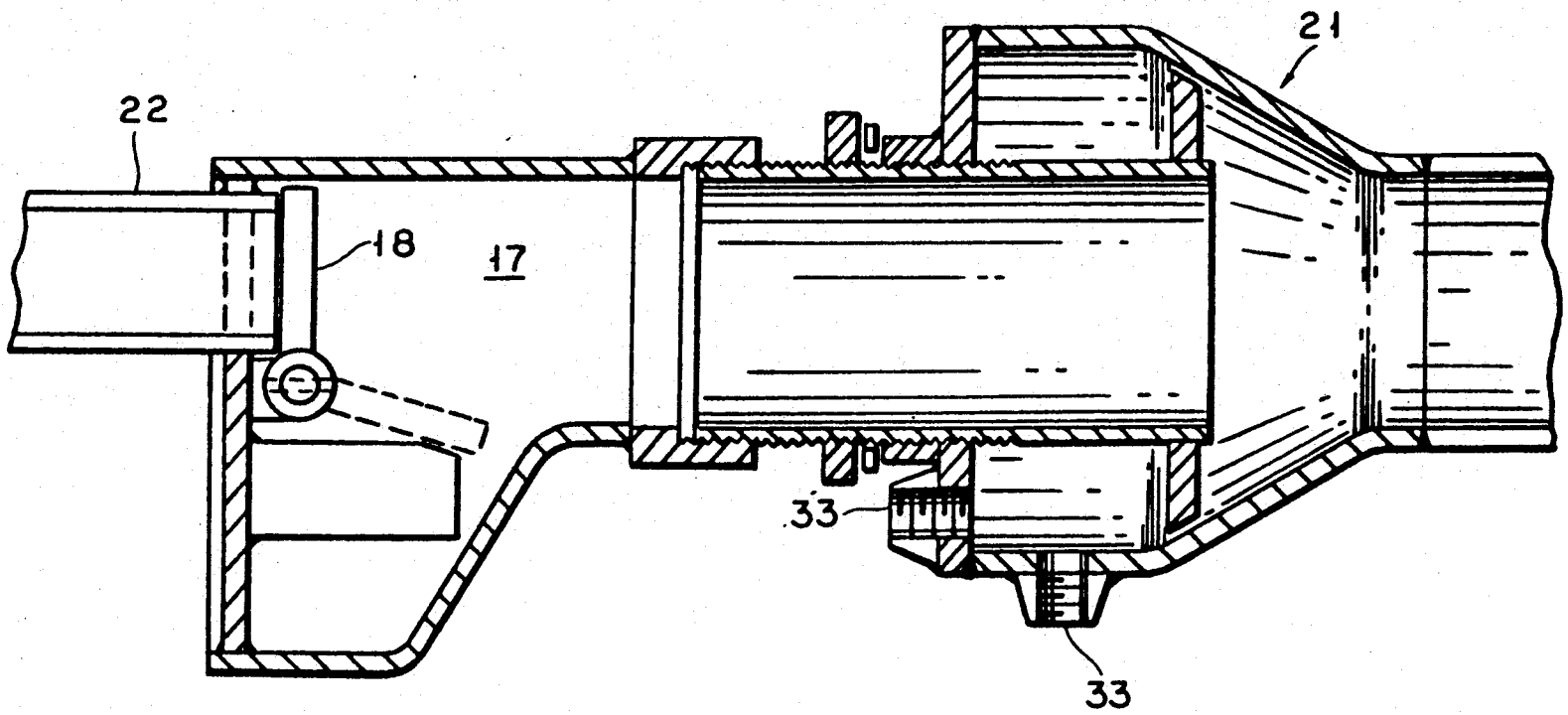
FIG. 5 is a longitudinal cross-section through a connecting member of a second embodiment.

Illustrated in FIG. 5 is an example of the invention whereby the connecting member 21 is inserted into a pipe line 22. The pipe line 22 has attached thereto a housing 17 into which a one way flap valve 18 is attached. When pumping is being effected, the flap valve 18 moves into the position indicated by broken lines. When the flap valve 18 returns to its rest position, the pipe line 22 is sealed. The connecting member 21 of FIG. 5 is also provided with two inlets 33.

Figure 6:
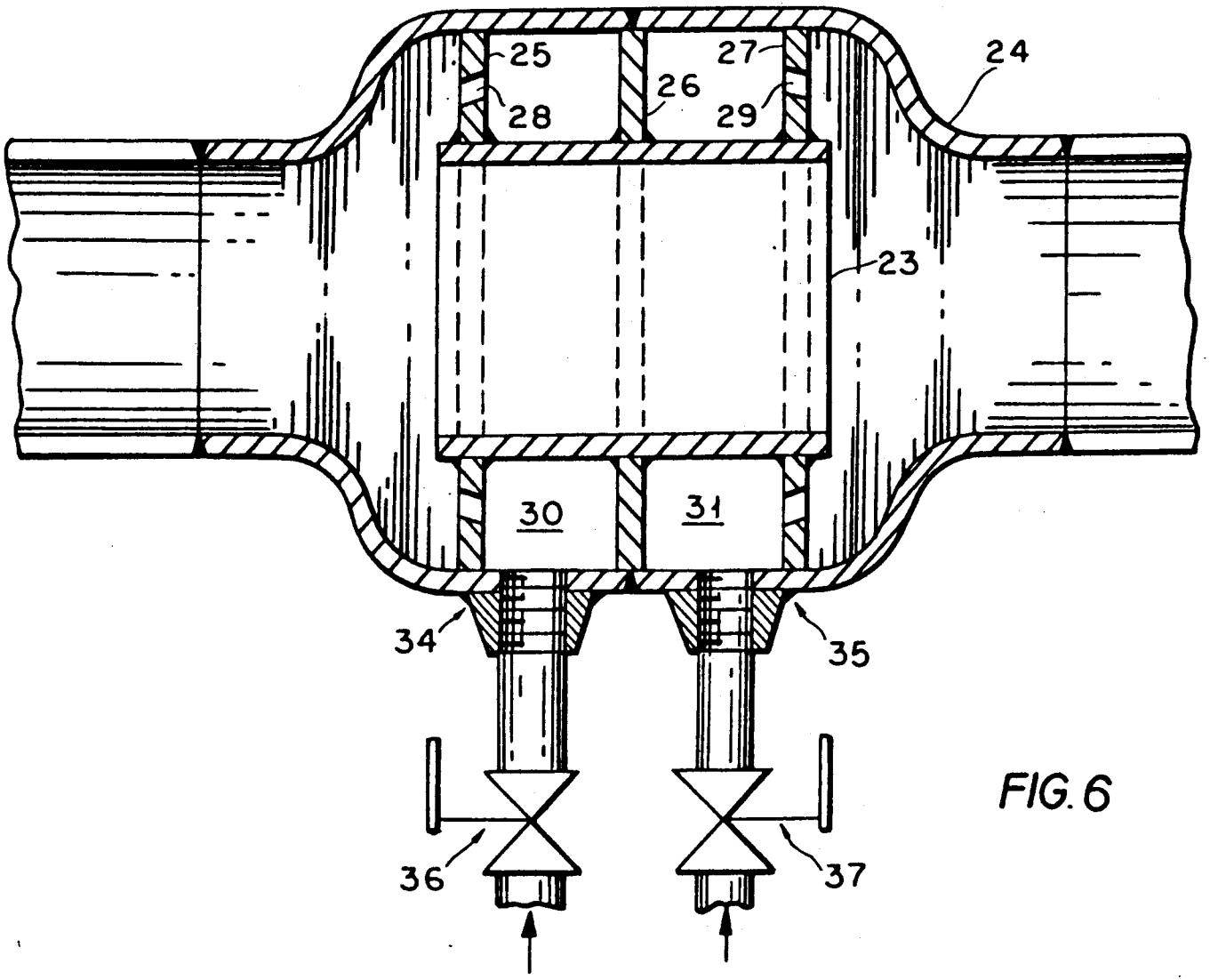
FIG. 6 is a longitudinal cross-sectional of a reversible suction-pumping connector of a third embodiment.

In FIG. 6, the arrangement illustrated shows a two way pumping/suction system whereby a centre inner pipe connector 23 is fixed inside an outer pipe 24. The inner pipe connector 23 is held in position by three annular ribs 25, 26 and 27. The two outer annular rings 25 and 27 have annular apertures 28 and 29 respectively. The apertures 28 and 29 act as the outlets to chambers 30 and 31 respectively. The chambers 30 and 31 have inlets 34 and 35 respectively which have valves 36 and 37 respectively. Each inlet 34 and 35 is used depending on the desired direction of flow and obviously only one inlet 34 or 35 is open at a particular time. The direction of flow is reversed inside the outer pipe 24 by opening and closing the valves 36 and 37.

Further embodiments of the present invention are illustrated in FIGS. 7 to 11. The connector 30 of the embodiment illustrated in FIG. 7 comprises a housing 31 into which an outer pipe connector 32 and an inner pipe connector 33 are located therein. Both pipe connectors 32 and 33 pass through end plates 34 and 35 of the opposite ends of the housing 31. The outer pipe connector 32 is welded into position on the end plate 34 whilst the inner pipe connector 33 is clamped into position by a clamping device 36 and O-ring 37. The inner pipe connector 33 is allowed to be reciprocated along its longitudinal axis inside the outer pipe connector 33 and housing 31. As illustrated in the drawing, the outer pipe connector 32 has a venturi shaped profile and the reciprocal movement of the inner pipe connector 33 allows the clearance between the outer pipe connector 32 and the inner pipe connector 33 to vary according to the position of the inner pipe connector 33.

The housing 31 has an inlet through which a high pressure fluid is introduced into the housing 31. The fluid then passes through the annular aperture 39 formed by the clearance between the inner pipe connector 33 and outer pipe connector 23. This particular embodiment works in a similar fashion to that of the embodiment of FIG. 1 in that the high pressure fluid increases in velocity as it passes through the narrowed annular aperture 39 and thus causing a vacuum to be created at the end 40 of the inner pipe connector 33. If the other end 41 of the inner pipe connector 33 is open, a vacuum is formed thus allowing any fluid, to be sucked or pumped through the connector 30.

Figure 8:
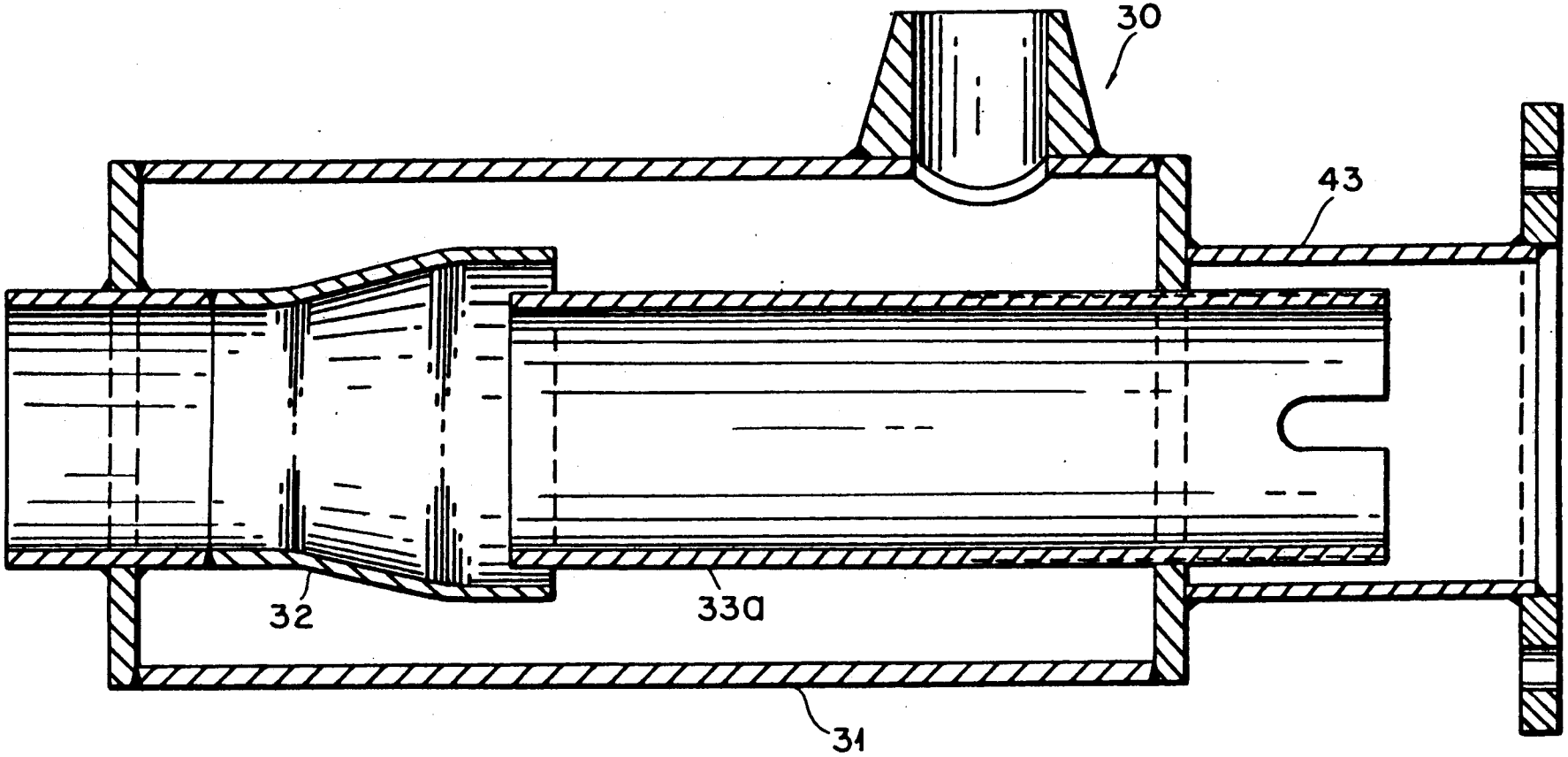

The embodiment of the present invention illustrated in FIG. 8 is similar to the embodiment in FIG. 7 except that the inner pipe connector 33*a* varies within a fixed inlet pipe 43 which is welded to the housing 31. The inner pipe connector 33*a* is also able to be reciprocated along its longitudinal axis thereby changing the clearance between the inner pipe connector 33*a* and the outer pipe connector 32.

Figure 9:
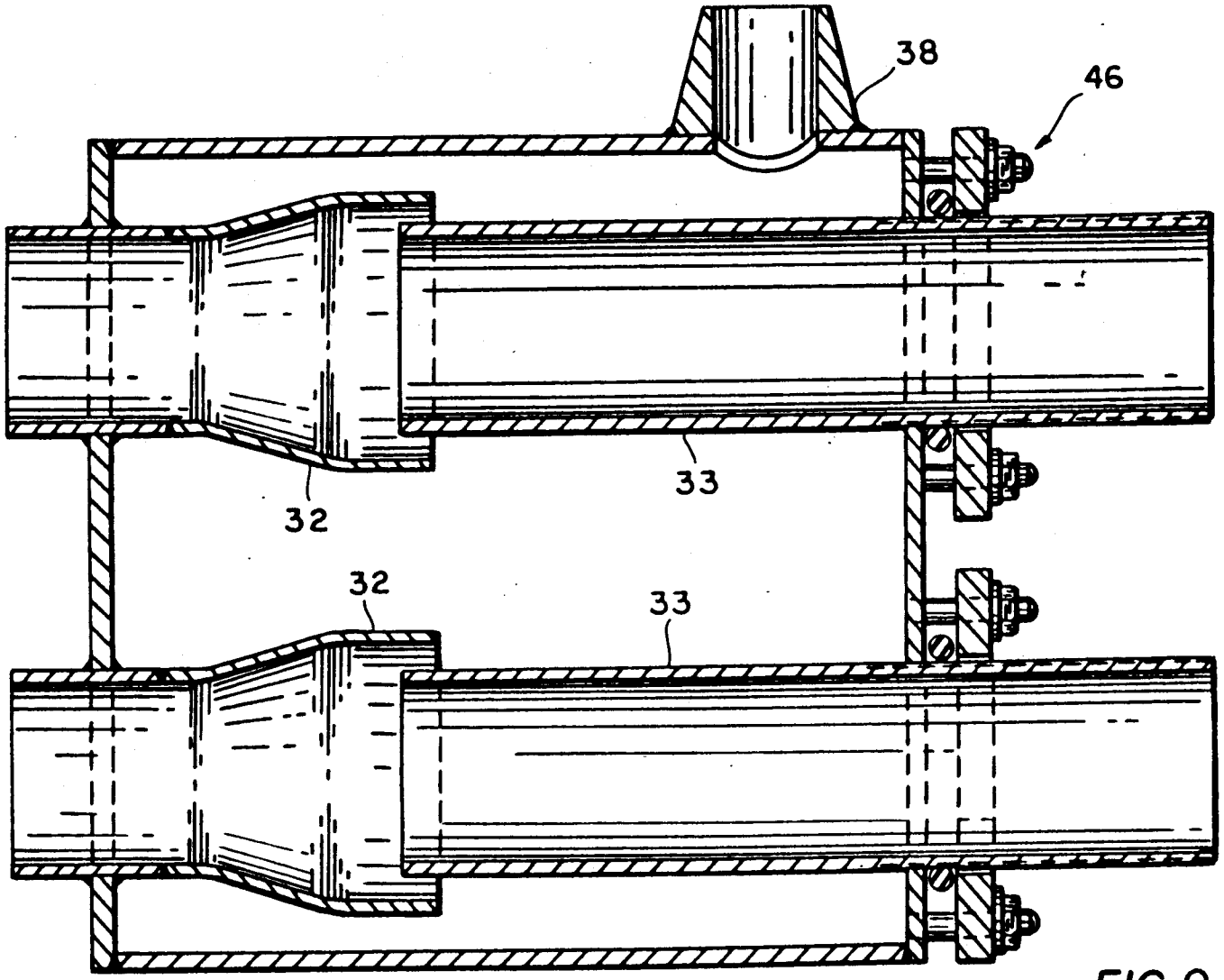
Figure 10:
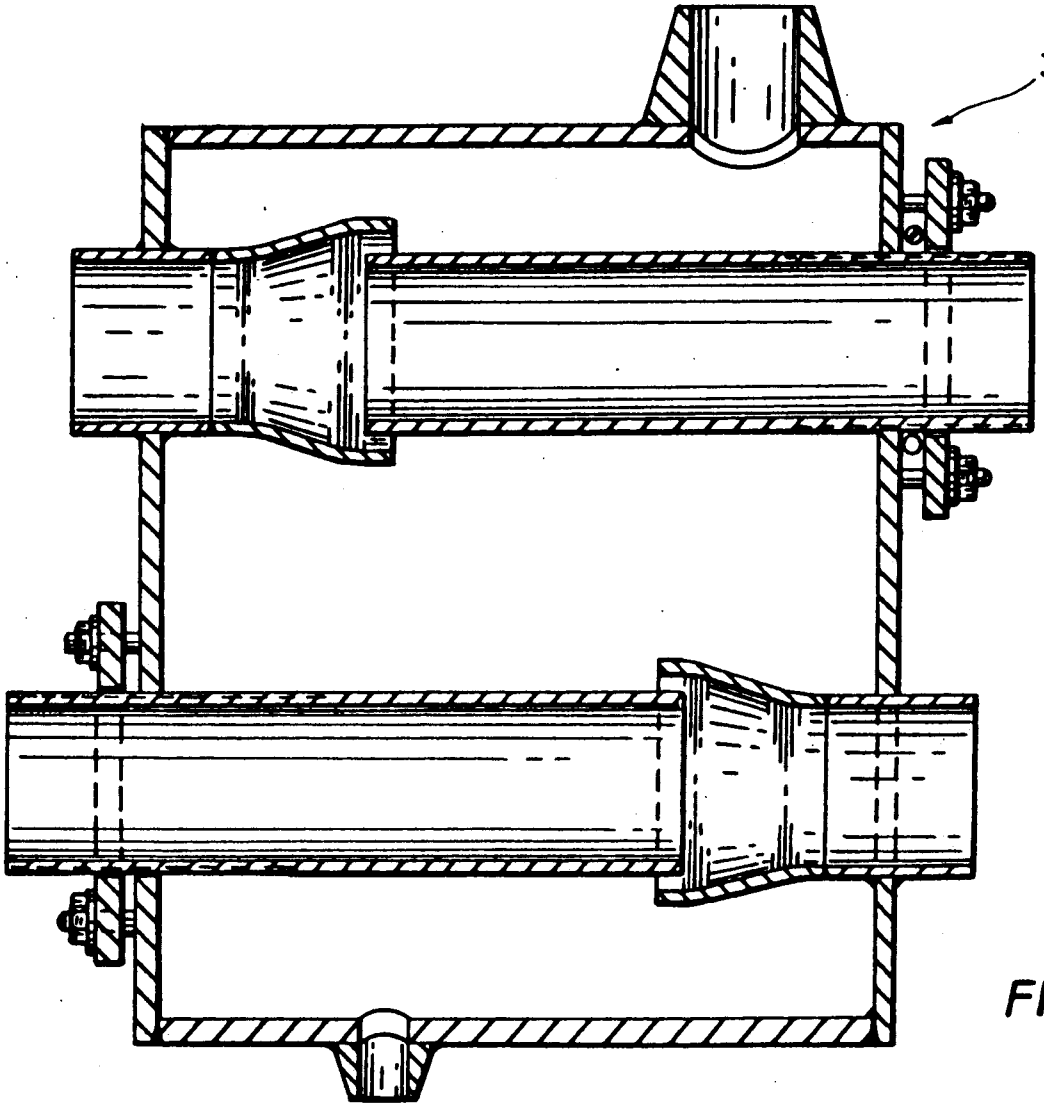

The embodiment of the present invention illustrated in FIG. 9 comprises a connector 40 which has a housing 31 in which a pair of inner pipe connectors 32 and outer pipe connectors 33 are arranged to pump a fluid in the same direction, whilst in the embodiment illustrated in FIG. 10, a pair of connectors 30 are arranged to pump fluids in opposite directions.

Figure 12:
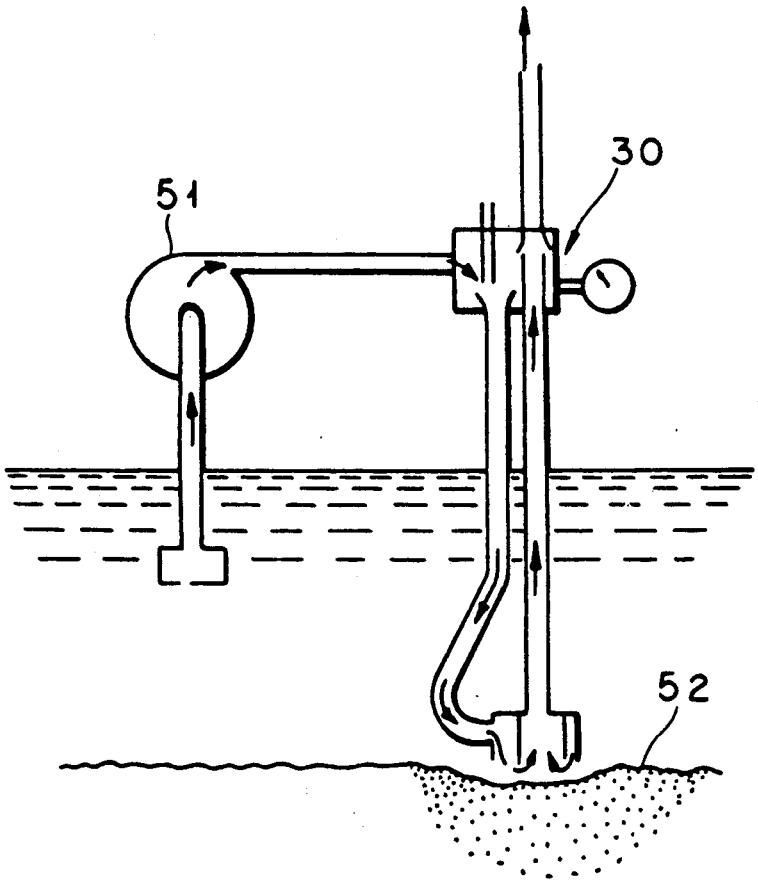
FIG. 12 is a schematic diagram illustrating the apparatus of FIG. 10 in use.

This is illustrated in FIG. 12 where the connector 40 is used for dredging whereby a pump 51 forces water through one connector 30 which accellerates a water and air mixture at the sea bed 52 which then causes a disturbance of the material of the sea bed which subsequently sucked through another connector 30 in the form of an air, water and bed material mixture.

Figure 11:
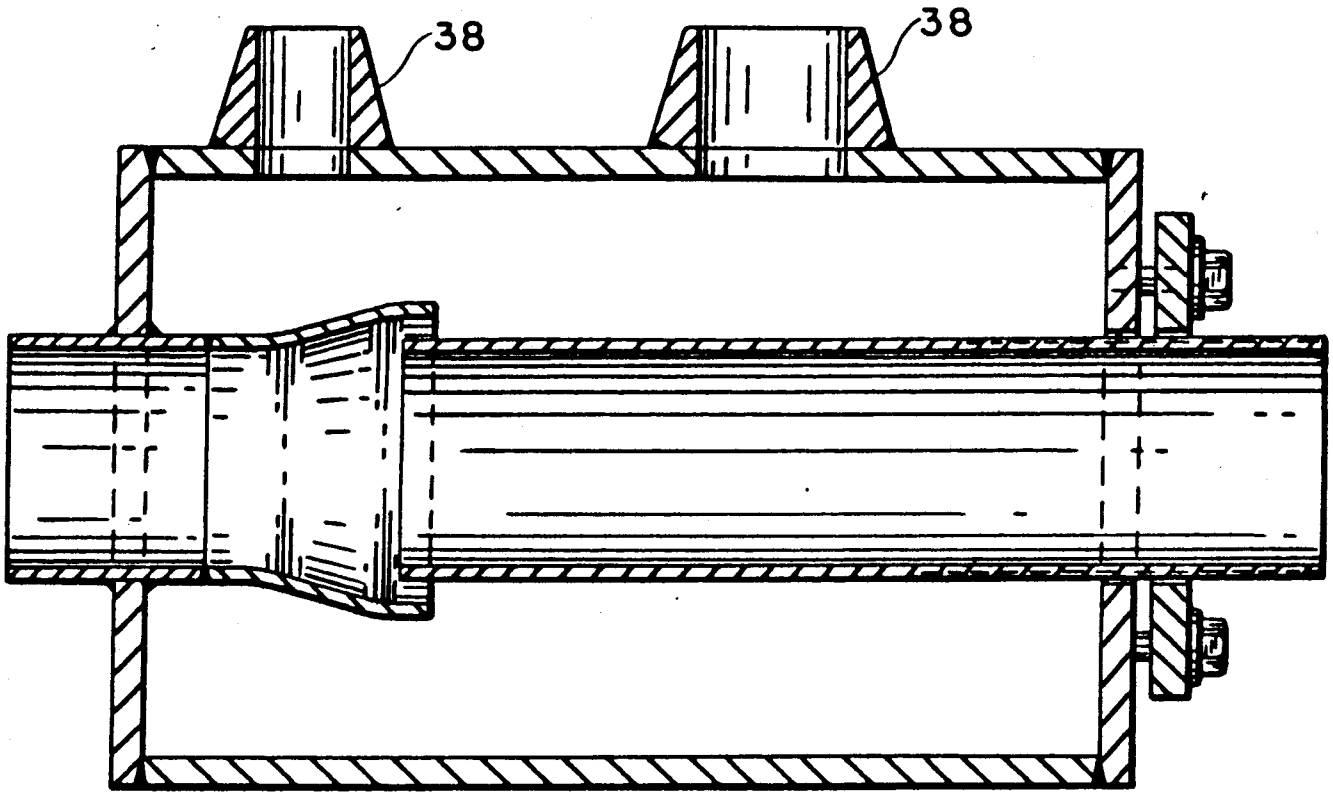

In the embodiment illustrated in FIG. 11, there are two inlets 38 in the housing 31 which assist in the movement of fluid in the housing 31.

An arrangement is illustrated in FIG. 13 whereby two connectors 30 are set up in series with a T connection 44 offshooting the connector between the two housings 31. Such an arrangement is used to either pump fluids from one area to another or visa versa using the T connection for flow in either direction. An air vent is attached to valve 61 so that an air mixture with water can be used to assist pumping.

In FIGS. 14 and 15, pumping arrangements using the connectors of the present invention are used to propell water craft. In FIG. 14, water is drawn through a pump 45 situtated in the water craft 46. The water is extracted from the water on which the craft 46 is situated. The water is pumped into a housing 31 and connected with an air supply from the inner pipe connector 33. The air and water is mixed together within the outer pipe connector 32 and expelled through an outlet 50 at the rear of the water craft 46 thus propelling the craft forward.

In the example illustrated in FIG. 15, the connector 30 is located in the water whereby the mixture which is used to propell the craft forward is a water mixture. The water pumped into the housing 31 sucks the water through the inner pipe connector 33 and through the outer pipe connector 32 thus forcing the craft in a forward direction.

Another embodiment of the invention is illustrated in FIG. 16. In this embodiment a connector 30 in a housing 31 has a movable inner pipe connector 3 which is adjustable by a coil spring, and hydraulic pressure.

Illustrated in FIG. 17 is an arrangement 51 which is used to operate a pool spa or like apparatus. The arrangement 51 illustrated is attached to a pool 52. An impeller 53 in a pump 54 sucks water through a strainer 55 from the pool 52. The water is used to create the vacuum in the connector 3 to therefore suck more water from another strainer 56 situated in the water of the pool. This water is drawn and accelerated through the connector 3 and recirculated into the pool 52. Air is able to be mixed with the water, the air is obtained via holes 57 in an air inlet 58. The mixing of air is an optional feature. The apparatus is used to operate or recirculate water in a spa pool or alternate type arrangements.

The foregoing describes only some embodiments of the present invention, and modifications obvious to those skilled in the art can be made thereto without departing from the scope of the present invention.

What we claim is:

1. A water circulation device including a venturi pumping arrangement comprising a housing having one end of an inner pipe and one end of an outer pipe located therein, the inner and outer pipes being co-axial and telescopic, and a chamber being formed from the annular space between the inner and outer pipes, inlet means in said housing to permit a first fluid under pressure to be introduced into said housing and hence into said chamber, an outlet of restricted size leading from said chamber and directed towards one end of said inner pipe whereby passage of said first fluid through said outlet and beyond said one end of said inner pipe produces a reduced pressure within said outer pipe which is able to draw a second entrained fluid through said inner pipe through said one end of said inner pipe and into said outer pipe, means for enabling said annular space to be varied, and wherein said device includes a container holding said first fluid, said container having two outlet pipes and an inlet pipe, a first outlet pipe being connected to said housing, and a second outlet pipe being connected to said inner pipe for supplying said second entrained fluid thereto, whereby the fluid is recirculated into the container via the inlet pipe.

2. The device as according to claim 1 wherein a further chamber is formed between the housing and the inner and outer pipes which pass through apertures in said housing at opposite ends.

3. The device according to claim 2 wherein said housing is cylindrical with said apertures located at the ends thereof and said inlet means located on the arcuate surface of said cylindrical housing thereby ensuring an annular said chamber.

4. The device according to claim 1 wherein said outer pipe forms the housing, and said inlet means is located in the outer pipe with an end plate at the end of said outer pipe having an aperture through which said inner pipe passes through.

5. The device according to claim 1 wherein said annular space is formed between a flange on said inner pipe and said outer pipe.

6. The device according to claim 1, wherein a pump means communicates with said first outlet pipe and said housing to pump said first fluid to said housing.

* * * * *